US007261208B2

(12) United States Patent
Stummer et al.

(10) Patent No.: US 7,261,208 B2
(45) Date of Patent: Aug. 28, 2007

(54) METHOD AND INSTALLATION FOR DRYING SLUDGE

(75) Inventors: Giselher Stummer, Kumberg (AT); Christian Maier, Fürstenfeld (AT)

(73) Assignee: Andritz AG, Graz (AT)

( * ) Notice: Subject to any disclaimer, the term of this patent is extended or adjusted under 35 U.S.C. 154(b) by 82 days.

(21) Appl. No.: 10/297,290

(22) PCT Filed: Jun. 7, 2001

(86) PCT No.: PCT/EP01/06497

§ 371 (c)(1),
(2), (4) Date: Apr. 21, 2003

(87) PCT Pub. No.: WO01/94866

PCT Pub. Date: Dec. 13, 2001

(65) Prior Publication Data

US 2004/0112796 A1 Jun. 17, 2004

(30) Foreign Application Priority Data

Jun. 9, 2000 (AU) ..... 10022000

(51) Int. Cl.
*B03B 9/00* (2006.01)
*F26B 7/00* (2006.01)

(52) U.S. Cl. ..... 209/11; 34/367; 34/371; 34/378

(58) Field of Classification Search ..... 209/11, 209/21, 28, 29, 913; 34/363, 367, 371, 378, 34/379, 423, 424, 480, 573, 591, 132; 210/770
See application file for complete search history.

(56) References Cited

U.S. PATENT DOCUMENTS 3,963,471 A * 6/1976 Hampton ..... 71/12
5,318,184 A 6/1994 Krebs
5,474,686 A * 12/1995 Barr ..... 210/771
5,775,004 A 7/1998 Steier et al.
5,960,559 A * 10/1999 Brunnmair et al. ..... 34/514
5,966,838 A * 10/1999 Krebs et al. ..... 34/479
6,006,440 A * 12/1999 Wiesenhofer et al. ..... 34/305
6,058,619 A * 5/2000 Krebs et al. ..... 34/79
6,161,305 A * 12/2000 Maier et al. ..... 34/315

FOREIGN PATENT DOCUMENTS

EP 537637 A1 * 4/1993
EP 0 789 209 B1 7/1996
GB 1 378 489 A * 12/1974

* cited by examiner

*Primary Examiner*—Joseph Rodriguez

(74) *Attorney, Agent, or Firm*—Alix, Yale & Ristas, LLP

(57) ABSTRACT

Apparatus and method for drying sludge, in particular sewage sludge, by creating a granulate from the dried product. A mixture of a carrier material consisting of recycled sludge which has already been dried and liquid sludge is fed to a dryer 6. The dried product is fed to a solids separator 8 after the dryer 6 and is stored intermediately in the former in an intermediate container that is placed immediately downstream of the separator.

16 Claims, 3 Drawing Sheets

METHOD AND INSTALLATION FOR DRYING SLUDGE

BACKGROUND OF THE INVENTION

The invention relates to a method for drying sludge, in particular sewage sludge, which produces granulate from the dried product. According to said method, a mixture of a carrier material, consisting of recycled sludge that has already been dried, and wet sludge is fed to a dryer. The invention also relates to an installation for carrying out said method.

Drum drying plants have been known for a number of years. This type of installation and method is described specifically for drying sludge, in particular sewage sludge, in e.g. EP 0 789 209 or U.S. Pat. No. 5,318,184. What these installations have in common is that they provide for carrier material, consisting of material that has already been dried, being mixed back into the liquid sludge in order to eliminate the so-called sticky phase. In order to do this, a large portion of the material that has already been dried is brought to a carrier material silo by a number of conveying elements. From here, it is added to the liquid sludge according to various controlling variables and after being mixed into it, fed to the dryer again. In order to be able to store the dried material in the silo, it has to be cooled using a special cooling device (e.g. a cooling screw). In addition, the silo for the carrier material must be of a special, expensive design for safety reasons.

SUMMARY OF THE INVENTION

The aim of the invention is thus to create a method and an installation with optimised safety features, high availability, as well as lower space requirements and manufacturing costs achieved by reducing the number of plant components.

The invention is characterised in that the dried product is fed to a solids separator after the dryer and is stored intermediately in the former or in an intermediate container that is placed immediately downstream of said separator, with the dry product used as carrier material being mixed into the liquid sludge without undergoing further storage. As a result, there is no further need for the carrier material silo, nor for the cooling device hitherto required.

A favourable further development of the invention is characterised by the filling level in the separator or intermediate container being controlled by an integrated conveyor, for example a conveying screw. As a result, it is always possible to achieve optimum addition to the liquid sludge on the one hand, and an optimum separation effect by the separator.

An advantageous configuration of the invention is characterised by the dry material undergoing intermediate storage in the inert sector. Since the dried material is stored in the inert part of the drying system, there is significantly less risk of fire or deflagration.

The invention also relates to an installation for carrying out said method. This is characterised by a solids separator with a storage volume or with a separate storage container for the dried material directly connected to the solids separator being provided after the dryer. As a result, there is no longer any need for the silo for carrier material required hitherto, nor for the cooling screw.

A favourable further development of the invention is characterised by the solids separator being a filter, where the solids separator can also be a cyclone. Thus, the plant can have a lower-cost design.

An advantageous configuration of the invention is characterised by a discharge device, for example a discharge screw conveyor, being integrated into the separator and/or storage container. This ensures optimum addition of liquid sludge on the one hand, as well as an optimum separating effect by the separator.

A favourable configuration of the invention is characterised by at least one conveying unit being provided between discharge device and mixer and which conveys the carrier material, consisting of sludge that has already been dried, from the separator to the mixer directly, i.e. without other units or containers being included in between. This conveying unit can be a tube or cubic chain conveyor, a vertical bucket conveyor, or a screw conveyor. A tube chain conveyor provides a facility for re-circulating the dried material that is to be back-mixed when the plant is shut down and for cooling it if necessary while it is being re-circulated, with the product always remaining in the inert sector. A vertical bucket conveyor is a favourable device for transporting the dried sludge and a screw conveyor is particularly good for controlling the amount added.

An advantageous further development of the invention is characterised by at least one more conveying unit, e.g. tube chain conveyor, cubic chain conveyor, vertical bucket conveyor or screw conveyor, being provided between the discharge device and the mixer.

This ensures optimum conveying of the dried material at all times, as well as optimum control of the amount to be back-mixed.

BRIEF DESCRIPTION OF THE DRAWINGS

The invention is described using the examples in the drawings, where.

DESCRIPTION OF THE PREFERRED EMBODIMENT

Figure 1:
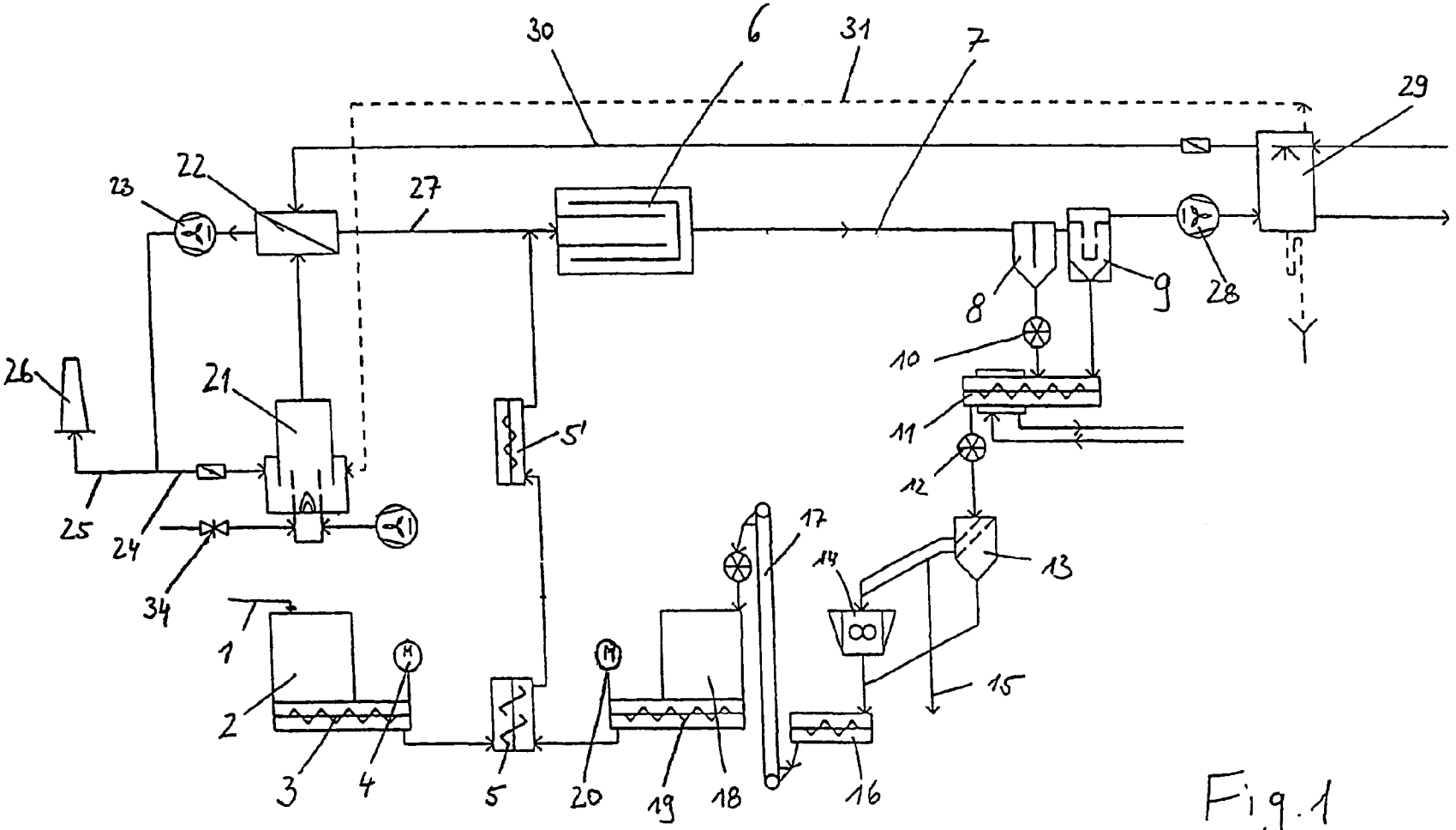
Fig. 1 PRIOR ART
FIG. 1 shows a state-of-the-art plant.

FIG. 1 illustrates a state-of-the-art drying plant, where pre-dewatered sludge 1 is fed to a container 2, from which it is fed via a feed screw 3, which is driven by an adjustable motor 4, is brought to a mixer 5 and goes from there through a further mixing and conveying screw 5' for example, into the dryer 6. As used herein, "wet sludge" encompasses liquid and dewatered sludge. Besides the triple-pass drum dryer shown, it would also be possible to use a fluidised bed, belt, or disc dryer. The dried material is carried by the drying air supplied through a duct 7 to a separator 8 and then passed on through a rotary vane feeder 10 to a screw conveyor 11. The fine solids particles that are left in the air after the pre-separator 8 are removed in a subsequent filter 9 and also fed to the screw conveyor 11. The screw conveyor is designed as a cooling screw in order to maintain the temperatures allowed for storage in the carrier material silo 18. The solids in the form of granulate are then fed through a lock 12 to a screening plant 13, where oversized grains are brought to a crusher 14 and the granulate with the designated size is conveyed through a duct 15 to packing and transport equipment. As an option, part of the grain with the designated size can also be fed to the crusher. The material milled in the crusher 14 is mixed with the very fine solids from the screen 13 and then brought to a carrier material silo 18 by a screw conveyor 16 followed by a vertical bucket conveyor 17. From here, the carrier material is fed to the mixer 5 through a carrier material feed screw 19, which is driven by a speed-adjustable motor 20. The energy for the drying process is generated according to FIG. 1 using a burner 21, which yields its heat to the circulating air in a heat exchanger 22. Some of the exhaust gas from the burner is returned to the burner though a duct 24 by means of a fan 23 or is brought through a duct 25 to the exhaust gas chimney stack 26 and then discharged into the atmosphere. The circulating air heated in the heat exchanger 22 is fed to the dryer 6 through the duct 27. As an alternative, the exhaust gas from the burner can also be fed directly to the dryer 6. The drying air is conveyed by a fan 28 located after the filter 9. This also guarantees that there is a vacuum in that part of the air system where material is conveyed, thus no dust can be released into the atmosphere. After the fan 28, the hot air charged with moisture is brought to a scrubber/condenser 29, where cooling water is injected. After this, the air that has now been cooled and dried is brought through a duct 30 to the heat exchanger again and thus, is re-used. A partial air current is brought from the scrubber 29 through a duct 31 to the burner for incineration.

Figure 2:
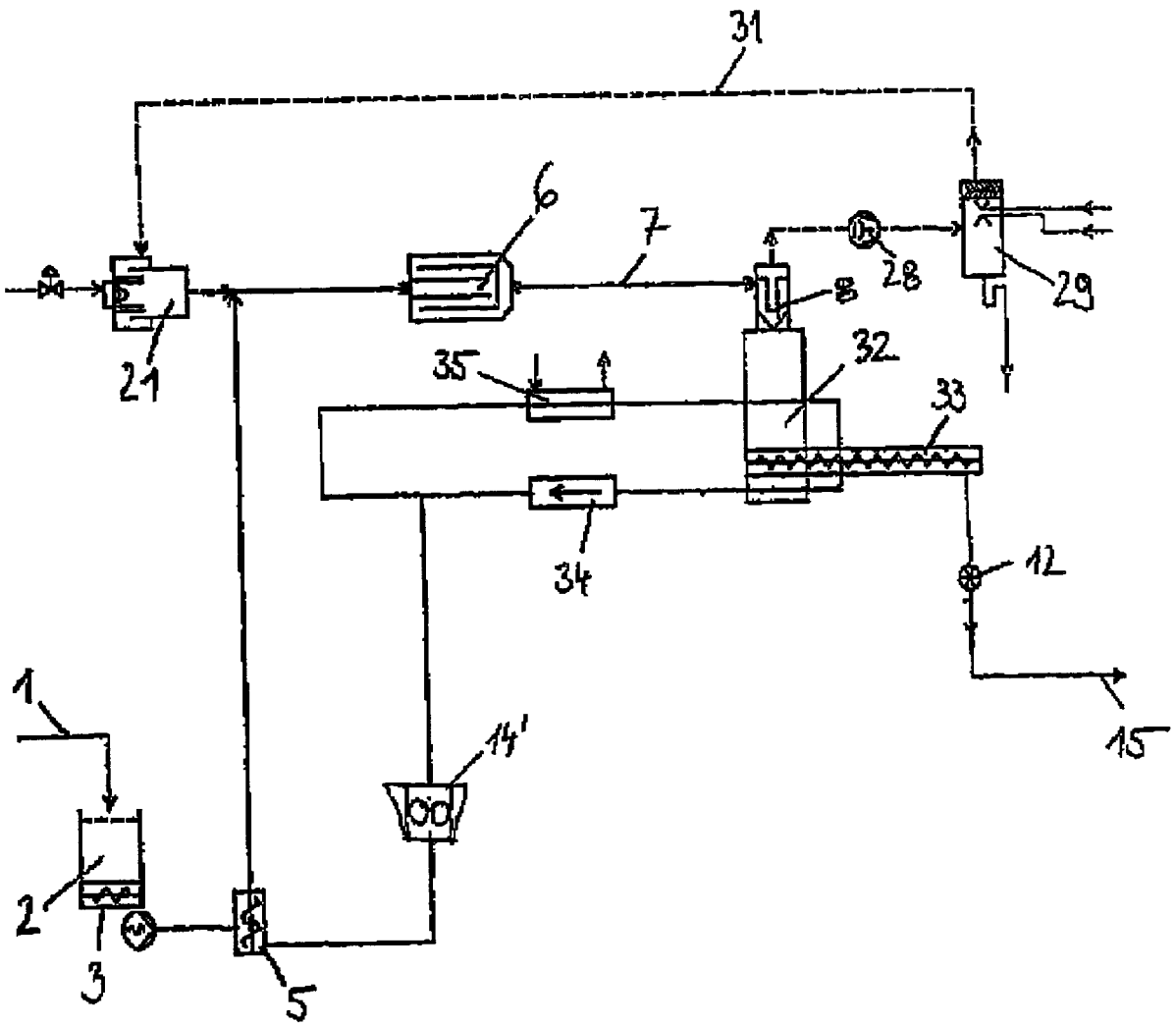
FIG. 2 shows a plant according to the invention.
Figure 3:
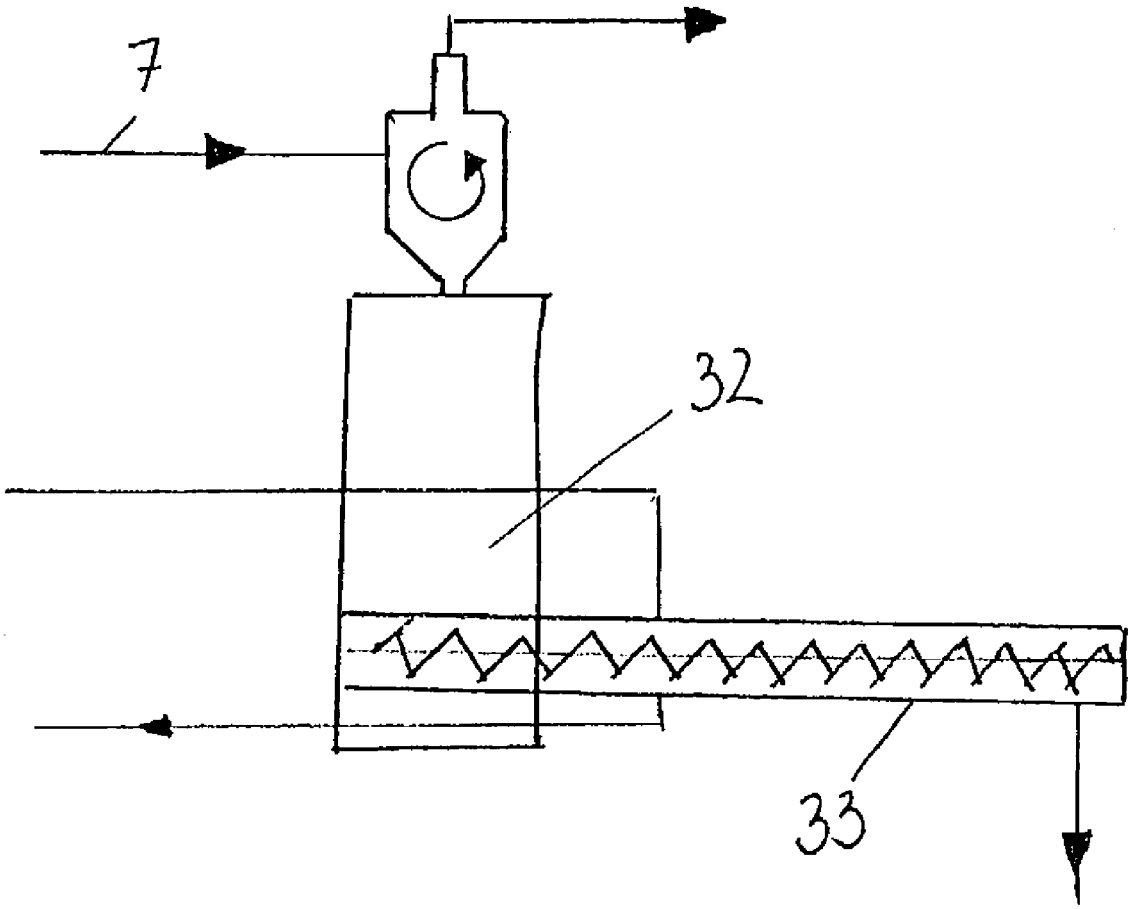
FIG. 3 shows an alternative solids separator.

FIG. 2 now shows a system according to the invention, where the same elements are marked with the same references. In contrast to FIG. 1, this illustration shows a system where the exhaust gas from the burner is fed directly to the dryer, which can also use an indirect heating system (with heat exchanger). The liquid sludge 1 is also dried here in a dryer 6 after being mixed with sludge that has already been dried. The dried material is separated from the drying gas in a separator 8. The illustration shows a storage section 32 of the separator 8, where the dried, granulated material is stored. Part of it is fed as final product through a discharge screw 33 to the rotary vane feeder 12 and then brought through duct 15 to the packing and transport devices. Thanks to the special arrangement of the discharge screw 33, whereby the effective flow rate of the final product can be modulated (e.g., by simple on/off or by variable rotation speed of the screw, as described above with respect to feed screw 19 with associated variable speed motor 20) the filling level in the container 32 is controlled. Instead of being stored in a separate container, the dried material can also be stored directly in the separator 8, where the discharge screw 33 then controls the filling level in the separator 8. The dried material used as carrier is conveyed to a crusher 14' and then directly to the mixer 5 by, for example, a tube chain conveyor 34. In the mixer, it is mixed with fresh, liquid sludge from the liquid sludge silo 2. In order to be able to re-circulate the dried material when the plant is shut down, an additional cooler 35 is provided here.

As a result, there is no need here for the cooling screw (11), nor for the carrier material silo (18) with screw (19) and drive (20) required by the state-of-the-art system. By storing the material in the separator 8 or a directly adjoining container 32, the material remains in the inert sector, i.e. in the enclosed system, with the drying gas, thus greatly reducing the risk of deflagration caused by dust, as well as the risk of fire.

The invention claimed is:

1. In a process for drying wet sludge, which produces granulate from the dried product, where a mixture of a carrier material, consisting of recycled sludge that has already been dried, and wet sludge is fed to a dryer, the improvement comprising that:

the dried product is fed to a solids separator after the dryer and stored there intermediately or in an intermediate container that is located immediately downstream of said separator in an inert sector of the process, the filling level in the separator or intermediate container is directly controlled by a conveyor integrated at least partially within the separator or intermediate container, and the dry product from the separator or intermediate container is used as said carrier material and is mixed into the liquid sludge without undergoing further storage.

2. A plant for drying wet sludge, which produces granulate from the dried product, where a mixture of a carrier material, consisting of recycled sludge that has already been dried, and wet sludge is fed to a dryer in an inert sector of the plant, comprising:

a solids separator with a storage volume or with a separate storage container for the dried material directly connected to the solids separator being provided in the inert sector after the dryer, a discharge device, integrated at least partially into the separator and/or storage container for directly controlling the fill level in the separator or storage container, and at least one conveying unit between the discharge device and the mixer, which conveying unit conveys the carrier material, consisting of sludge that has already been dried, from the separator to the mixer directly, without further storage.

3. The plant according to claim 2, wherein the solids separator is a filter.

4. The plant according to claim 2, wherein the solids separator is a cyclone.

5. The plant according to claim 2, wherein at least one conveying unit is a tube or cubic chain conveyor.

6. The plant according to claim 2, wherein at least one conveying unit is a vertical bucket conveyor.

7. The plant according to claim 2, wherein at least one conveying unit is a screw conveyor.

8. The plant according to claim 2, wherein at least one additional conveying unit selected from the group consisting of tube chain conveyor, cubic chain conveyor, vertical bucket conveyor or screw conveyor, is provided between the discharge device and the mixer.

9. A process for drying wet sludge in an inert sector of a plant to produce a granulate dried solids product, comprising:

mixing a carrier material consisting of recycled sludge that has already been dried, and wet sludge, and feeding the mixture to a gas dryer to produce a dried solids product;

separating the solids of the dried product from the gas in the gas dryer and storing the dried solids product in an associated container having a variable filling level;

directly controlling the filling level in the container by operation of a container discharge device mounted partly within the container for delivering the discharged dried product for processing as a final product; and conveying some of the dried product continuously from said container as carrier material for mixing with the liquid sludge;

wherein the drying gas is confined within the inert sector of the plant, and said storing of the product is performed in said inert sector.

10. A plant for drying wet sewage sludge in an inert sector of the plant to produce a granulate dried solids product, comprising:

a mixer;

means for introducing wet sludge into the mixer;

means for introducing a carrier material consisting of recycled, dried solids product into the mixer;

means downstream of the mixer for exposing the discharge from the mixer to a hot drying gas;

a solids separator with an associated storage container located in the inert sector for separating dried solids product from the gas and accumulating said separated solids product in said storage container;

a discharge control device mounted partly within the associated storage container, for delivering a controlled variable rate of dried solids product as a final product to a further processing station and thereby directly controlling the fill level in the container; and means for continuously delivering a portion of the dried solids product in said storage container to said means for introducing a carrier material into the mixer.

11. The plant according to claim 10, wherein said means for continuously delivering includes at least one conveying unit located between the discharge device and the mixer.

12. The plant according to claim 10, wherein the discharge device comprises a discharge screw conveyor.

13. The plant according to claim 12, wherein the screw conveyor is a variable speed screw conveyor.

14. The plant according to claim 13, wherein the means for continuously delivering includes at least one conveying unit located between the variable speed conveyor and the mixer.

15. The plant according to claim 10, wherein the storage container is integral with the separator.

16. The plant according to claim 10, wherein the storage container directly adjoins the separator.

* * * * *